United States Patent [19]

Seynhaeve

[11] Patent Number: 5,044,476

[45] Date of Patent: Sep. 3, 1991

[54] RIGID OR SEMI-RIGID SUITCASE MADE OF PLASTIC MATERIAL

[75] Inventor: Andre Seynhaeve, Senlis, France

[73] Assignee: Delsey S.A., Bobigny, France

[21] Appl. No.: 466,941

[22] Filed: Jan. 18, 1990

[30] Foreign Application Priority Data

Jan. 20, 1989 [FR] France ..... 89 00643

[51] Int. Cl.[5] ..... A45C 5/14; A45C 13/04

[52] U.S. Cl. ..... 190/18 A; 190/115; 190/119; 190/121; 190/122; 190/123

[58] Field of Search ..... 190/18 A, 18 R, 122, 190/127, 119, 123, 124, 120, 121, 115

[56] References Cited

U.S. PATENT DOCUMENTS

| | | | |
|---|---|---|---|
| D. 211,621 | 7/1968 | Holtzman . | |
| 2,596,578 | 5/1952 | McIntyre et al. | 190/18 A X |
| 2,832,448 | 4/1958 | Axtell . | |
| 2,950,793 | 8/1960 | Axtell | 190/121 X |
| 3,198,299 | 8/1965 | Axtell et al. | 190/122 X |
| 3,298,479 | 1/1967 | Palmer et al. | 190/127 X |
| 3,306,403 | 2/1967 | Heitler et al. | 190/127 X |
| 3,497,041 | 2/1970 | Samhammer . | |
| 3,557,917 | 1/1971 | Kaplan | 190/121 |
| 3,780,838 | 12/1973 | Slan | 190/121 |
| 3,948,365 | 4/1976 | Gregg et al. | 190/18 A |
| 3,962,010 | 6/1976 | Riou et al. | 190/122 X |
| 4,094,392 | 6/1978 | Gregg et al. | 190/120 |
| 4,544,050 | 10/1985 | Seynhaeve | 190/18 A X |
| 4,621,404 | 11/1986 | Browning | 190/127 X |
| 4,693,346 | 9/1987 | Fuersdijk | 190/122 X |
| 4,823,924 | 4/1989 | Goodin | 190/122 X |
| 4,854,602 | 8/1989 | Takeuchi | 190/122 X |

FOREIGN PATENT DOCUMENTS

| | | | |
|---|---|---|---|
| 0079395 | 5/1983 | European Pat. Off. . | |
| 2015530 | 12/1970 | Fed. Rep. of Germany | 190/122 |
| 1958686 | 6/1971 | Fed. Rep. of Germany | 190/122 |
| 2000776 | 7/1971 | Fed. Rep. of Germany . | |
| 2135463 | 2/1973 | Fed. Rep. of Germany . | |
| 2213582 | 10/1973 | Fed. Rep. of Germany | 190/18 A |
| 8301730 | 5/1983 | PCT Int'l Appl. | 190/122 |

*Primary Examiner*—Sue A. Weaver

*Attorney, Agent, or Firm*—Finnegan, Henderson, Farabow, Garrett & Dunner

[57] ABSTRACT

A rigid or semi-rigid suitcase consists of a central frame forming a closed rigid annulus to which are assembled two rigid shells, one shell being welded to one side of the frame and the other shell being hinged on the other side. The suitcase is further characterized in that the central frame, made of a single piece, is shaped so that it comprises, in its latch portion or top panel, a recess closed by a reinforcing member with which the recess cooperates so as to form a hollow beam serving as a stiffening member for the top of the suitcase, the hollow beam receiving the locking mechanisms, the central handle and the lateral handle of the suitcase.

25 Claims, 5 Drawing Sheets

20-21
20-21
1
2
3
3
3
23
1
2
3
5
1
4
2
30
30
3

12
13
11
11b
15
12
11a
14
5
10
1
18
15a
10b
6
4
10a
9
7
8

RIGID OR SEMI-RIGID SUITCASE MADE OF PLASTIC MATERIAL

This invention relates to a rigid or semi-rigid suitcase made of plastic material.

It is known for instance from U.S. Pat. No. 2,832,448 to produce a suitcase of this kind with two shells hinged together, the rims of which fit into each other. It is also known from the U.S. Design Pat. No. 211,621 to place on one of the shells a metal strip and on the other shell a metal groove receiving this strip. It is further known from U.S. Pat. No. 3,497,041 to provide each shell with a peripheral rib and to place between the two ribs a metal belt forming a frame. The drawback of this arrangement is that the two ribs form with the metal belt a kind of rather wide groove, the aspect of which is not very atractive, while its edges present protrusions liable to injure the user. Also, the manufacturing of such a suitcase is complex and therefore costly. It is also known to suppress the metal belt so that the two ribs will be butt-jointed, but while this improves the appearance of the suitcase and simplifies its manufacture, there always remains a peripheral protrusion which presents drawbacks.

It is an object of this invention to provide a suitcase free of any protrusion, which can be produced in a simple and therefore cost-saving manner. For this purpose, the suitcase is made of three assembled elements, namely a central element and two shells, one shell being welded to one side of the central element and the other shell being hinged to the other side thereof. The fact of forming a suitcase with three elements is, known per se, for instance from German Patent Nos. 21 35 463 and/or 20 00 776 and from European Patent No. 79.395; however, these known devices are unsatisfactory because they were either too heavy or not strong enough.

The suitcase according to this invention is a rigid or semi-rigid suitcase consisting of a central frame forming a closed rigid annulus to which are assembled two rigid shells, one shell being welded to one side of the frame and the other shell being hinged on the other side, characterized in that the central frame, made of a single piece, is shaped so that it comprises in its latch portion (or top panel) a recess closed by a reinforcing member with which said recess cooperates so as to form a hollow beam serving as a stiffening member for the top of the suitcase, this hollow beam receiving the locking mechanisms, the central handle and the lateral handle of the suitcase.

The suitcase may also include the following features:

(a) the hollow beam may extend over a portion of the length of the front of the suitcase, or over the full length thereof, or may even extend to a portion of the front and rear walls (the ends) of the suitcase;

(b) the reinforcing member is placed in continuation with the surfaces of the two shells, so that the suitcase will offer a smooth external surface, without any bumps;

(c) the recess and the reinforcing member are provided with perpendicular ribs fitting into each other;

(d) the central frame is provided on its lower or bottom portion with two rails intended to allow it to slide over obstacles.

Further features of the invention will emerge from the following description, with reference to the appended drawings in which.

The terminology concerning hand-held luggage items, such as suitcases, being determined by the French Standard NF H No. 48-004, the description of the suitcase which is the object of this invention will be made in accordance with the terminology of this Standard.

Referring to the Figures, it will be seen that the suitcase is composed of a central frame 1 moulded as a single piece, to which is welded a first shell 2 forming the tub of the suitcase, and with which is hinged a second shell 3 forming the lid of the suitcase.

In the example illustrated, both shells 2 and 3 are symmetrical, but the invention is not restricted to this specific exemple.

Figures 1, 2, 3:
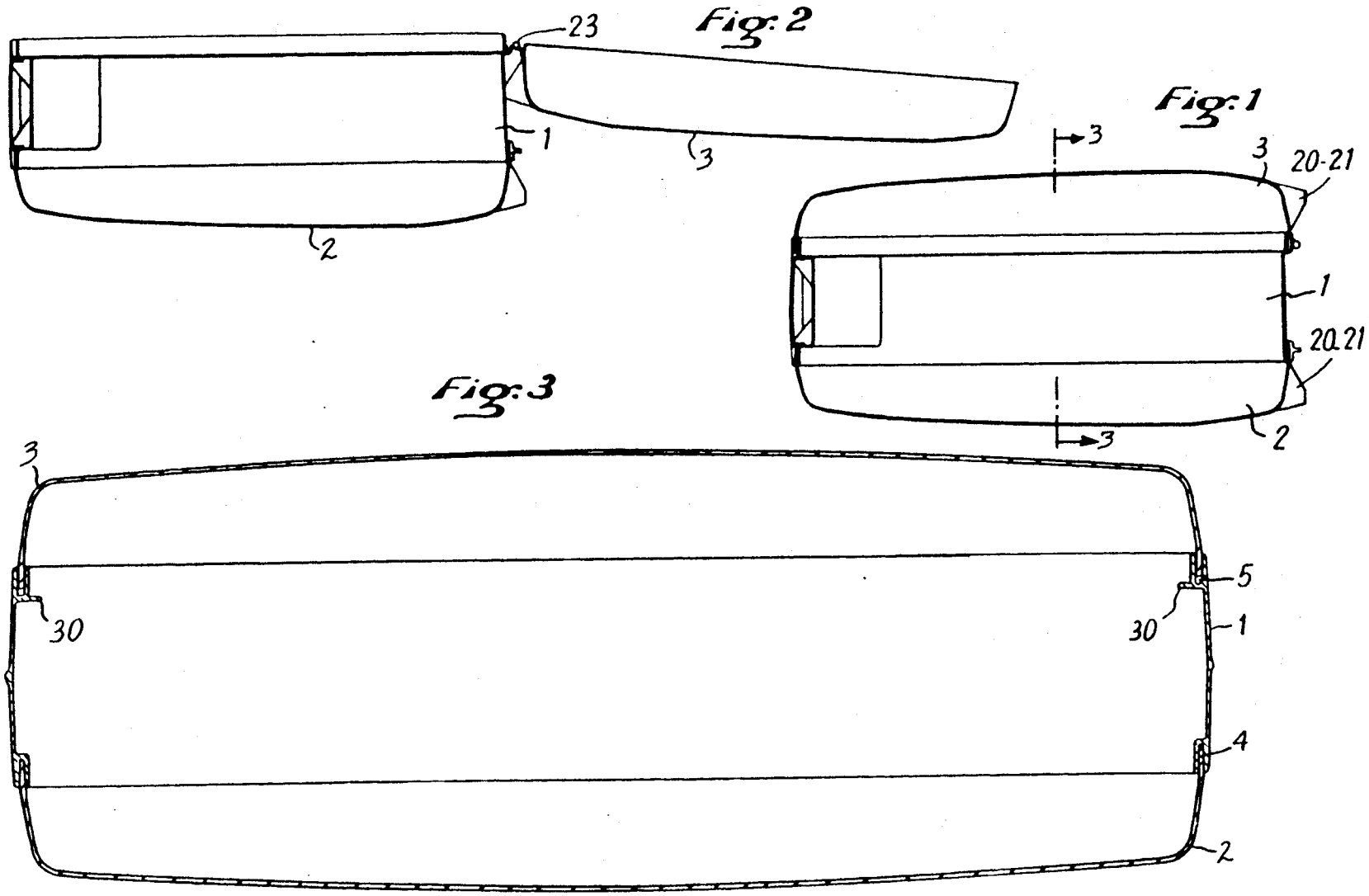
FIG. 1 is a front side elevation of the suitcase of this invention.
FIG. 2 shows the suitcase of FIG. 1 when open.
FIG. 3 is a cross-section view along line 3—3 of FIG. 1.

As shown in FIG. 3, the frame 1 presents two grooves inside which will fit respectively the edges or peripheries of the two shells 2 and 3. The periphery of shell 2 is welded, by any appropriate means, inside the lower groove 4 at one peripheral edge of the central frame 1, while the periphery of the shell 3, the lid to the suitcase will engage the upper groove 5 at the other peripheral edge of the central frame when the suitcase is closed and will be released therefrom when the suitcase is opened.

Figure 7:
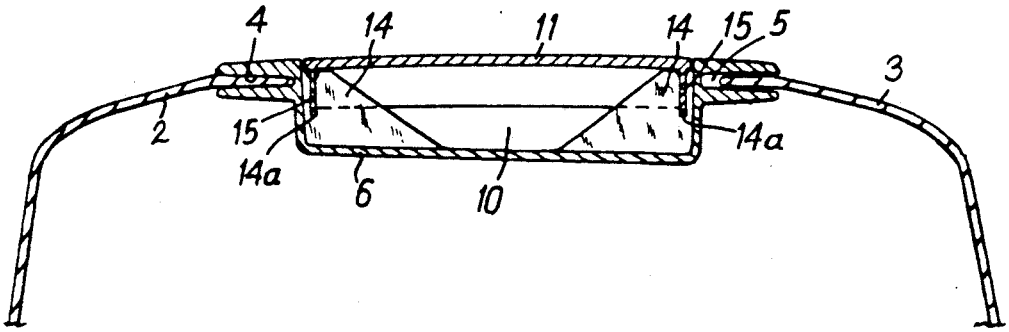
FIG. 7 is an enlarged partial cross-sectional view taken along line 7—7 in FIG. 10.

It will be observed that the periphery of the shell 3 is free of any bead, stiffening rib or band or any other reinforcing member. The rigidity of the luggage is obtained by engagement of shell 3 in frame 1. This is achieved by forming, as depicted in FIGS. 3 and 7 the upper groove 5 of the frame 1 with a very substantial depth (approximately 2.5 cm) and a small width (approximately 0.4 cm) and by making the walls of this groove 5 slightly converging, so as to gradually achieve a clamping effect as the periphery of the shell 3 is pushed down into said groove.

Figures 5, 6:
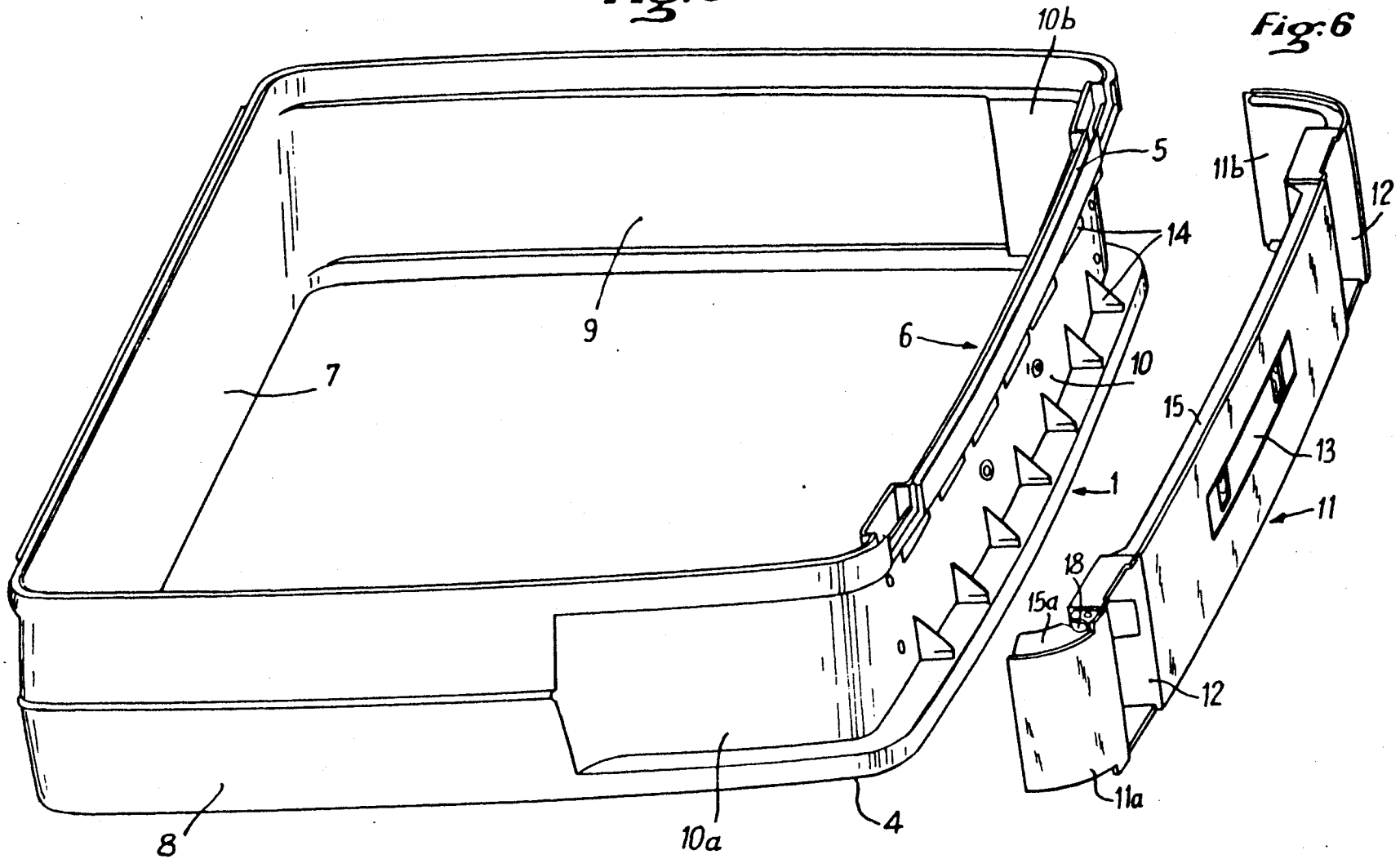
FIG. 5 is a perspective view of the central frame of the suitcase of FIG. 1 without the shells.
FIG. 6 is a perspective view of the reinforcing member of the suitcase of FIG. 1.

From FIG. 5 it can be seen that the frame 1 is rectangular, formed of a single piece. It is made of a material appropriate for rendering it rigid. Preferably, it is made of an injection-moulded plastic material. This frame comprises a top panel 6, a bottom panel 7, front panel 8 and rear panel 9.

According to this invention, the top panel 6 is formed with a recess 10 forming a housing. In the exemple illustrated, this recess extends not only over the full length of the top panel 6, but it also extends over portions 10*a*, 10*b* of the front and rear panels 8 and 9, respectively. However, the invention is not restricted to the specific example, since the recess 10 may extend over only a portion of the length of the top panel 6, or also it may extend over the top panel only, without extending over the front and rear panels 8 and 9.

FIG. 6 shows a reinforcing member 11 intended for fitting into the recess 10 so as to form a hollow beam together with this recess. This reinforcing member 11 comprises two housings or cavities 12 intended for receiving the locking devices and a central plate 13 provided for receiving the handle by means of which the suitcase will be carried.

FIG. 5 shows that the recess 10 comprises along its two sides a plurality of ribs or webs 14, while the reinforcing member 11 carries two ribs 15, one depicted in FIG. 5. The webs 14 are perpendicular to the median plane of the suitcase, while the ribs 15 lie parallel to this plane. FIG. 7 shows that the webs 14 are provided with slots 14*a* which will be engaged by the ribs 15 of the reinforcing member 11. This provides for a firm assembly of the reinforcing member 11 with the recess 10, so that a very strong hollow beam will thus be obtained.

When comparing FIGS. 5 and 6, it will be seen that the curved portion 11*a* of the reinforcing member 11 is shorter than the corresponding portion 10*a* of the recess 10. As a result, the reinforcing member will cover only a part of this portion 10*a*.

Figure 12:
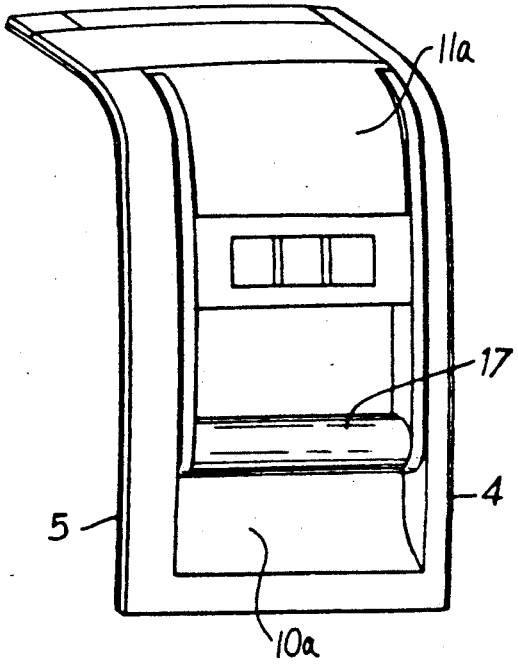
FIGS. 12 and 13 are two enlarged perspective views illustrating the lateral or side handle.
Figure 13:
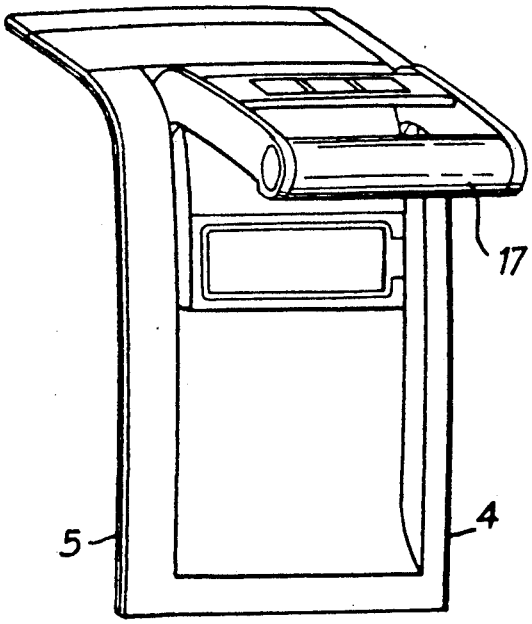

This makes it possible to place in this location 10*a* a handle 17. This handle is maintained by a spring (not shown) in its retracted position in recessed portion 10*a* as shown in FIG. 12. This handle 17 swivels about a shaft engaging two apertures 18 formed in the two extensions 15*a* of the ribs 15 at one end of reinforcing member 11 as depicted in FIG. 5. This handle 17 forms the traction or side handle located on one of the front or back panels 8, 9 of the suitcase.

Figure 4:
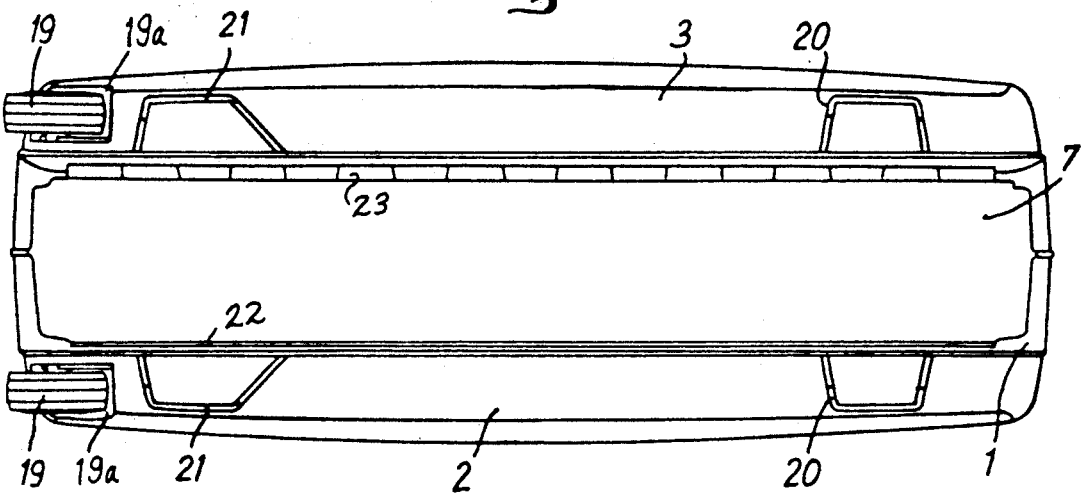
FIG. 4 is a bottom plan view of the suitcase of FIG. 1.
Figure 8:
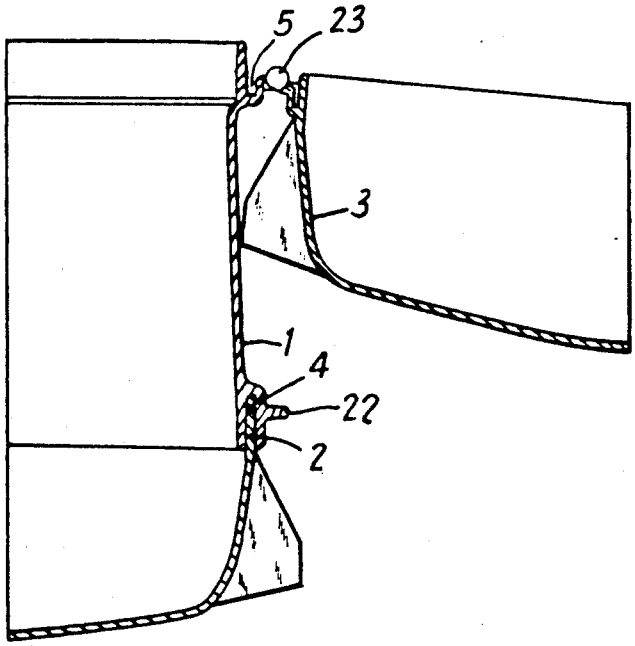
FIG. 8 is an enlarged partial cross-sectional view taken along line 8—8 of FIG. 10 with the suitcase open as depicted in FIG. 2.

Referring to FIGS. 4 and 8, the portion of each shells 2 and 3 adjacent the intersection of the rear panel 9 and bottom panel 7 comprises a recess 19*a* each receiving a wheel 19. Each of shells 2 and 3 further comprise a front skid 20 and a rear skid 21. The bottom panel 7 of the frame 1 carries a rib 22 and a hinge 23. The hinge 23 is arranged along the outer edge of the groove 5, while the rib 22 is placed along the outer edge of the groove 4 (FIG. 8). The rib 22 is designed so that its end will define, with the outer edge of the hinge 23, a plane being perpendicular to the median plane of the suitcase.

Figure 10:
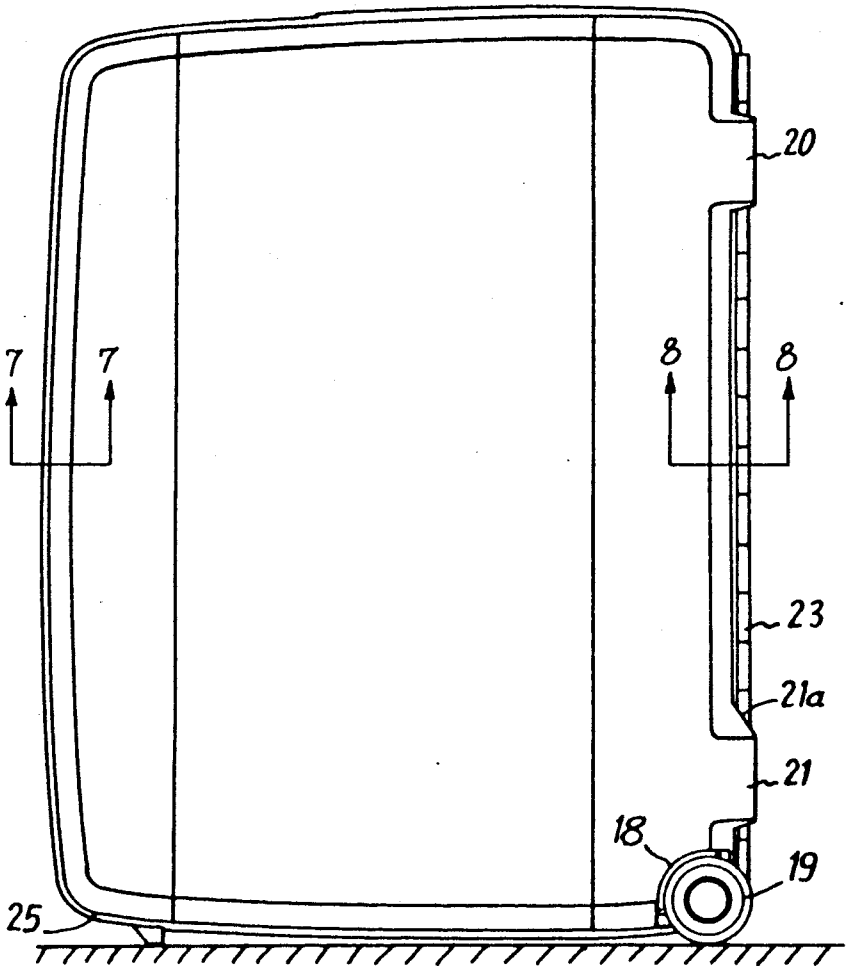
FIG. 10 is a view corresponding to FIG. 9, the auxiliary castor being retracted.
Figure 9:
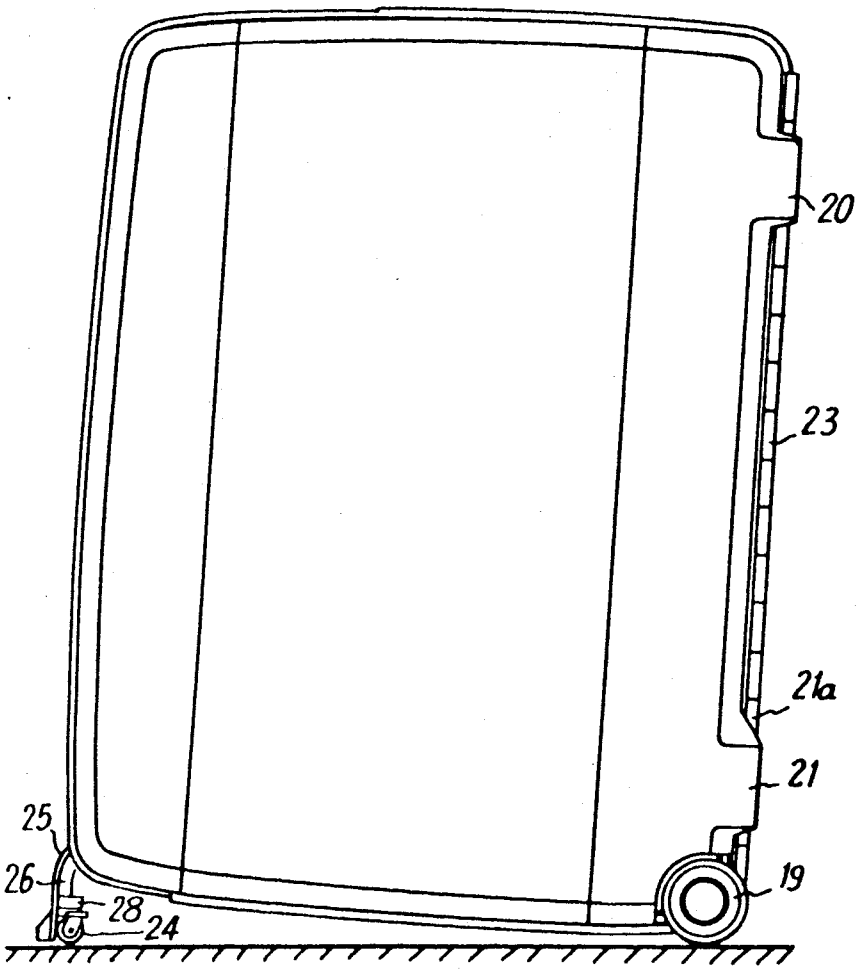
FIG. 9 is a side elevation view of a modified embodiment of the invention incorporating an auxiliary caster.

FIGS. 9 and 10 show that the skids 20 and 21 are protruding beyond this plane, so that when the suitcase is placed down vertically, it will rest on its skids. When pulling the handle 17, the suitcase rests on its two wheels 19, but when walking up a stairway, the rib 22 and the hinge 23 may slide against the edges of the stairs, so that they may perform the function of two skids. For preventing the rear skids 21 from catching with the edge of a stair upon contacting this edge, the front edge 21*a* of the rear skids 21 is slanted.

Figure 11:
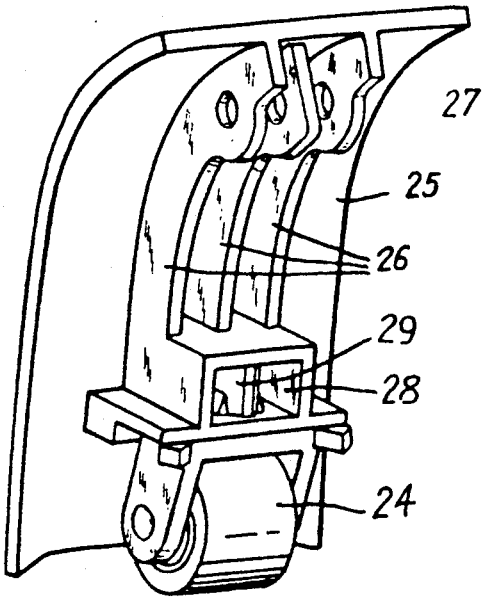
FIG. 11 is a perspective enlarged view of a detail, illustrating the auxiliary castor.

FIGS. 9, 10 and 11 relate to a modified embodiment in which there is placed, in the recess portion 10*b* of the recess 10 in rear panel 9 opposite to the one where the traction handle is located, an additional castor 24 which may be retracted within said recess portion 10*b*.

This castor 24 is carried by a curved plate 25, this plate being curved so as to cover the portion 10*b* of the recess 10 as a continuation of the reinforcing member 11. This plate 25 is provided with ribs 26 perforated by holes 27 which receive the swivelling shaft of this plate 25. These ribs 26 also carry a housing 28 inside which is mounted a swivelling shaft 29 for the castor 24.

FIG. 10 shows the castor 24 in its retracted position when the plate 25 has been rotated, while FIG. 9 shows this castor 24 in its extended position. In this position, it will be easy to move the suitcase along by pulling it or pushing it by means of the handle 17. The suitcase will then roll easily on the ground, since the castor 24 is free to swivel about the axis 29 in any desired direction.

It can be noted that the recess 10 and its portions 10*a* and 10*b*, as well as the reinforcing member 11, the plate 13 and the plate 25 are all arranged in such manner that the external surface of the suitcase is smooth, without any bump. For this purpose, the locking elements located in the cavities 12 are designed so that their external surface will form a continuation of the external surface of the reinforcing member 11.

All these features make it possible to produce, at a moderate cost, a suitcase free of any protrusion, of light weight and very easy to handle.

As shown in FIG. 3, the central frame 1 may advantageously be provided with a wing 30 extending inwardly and located practically at the base of the groove 5, in parallel with the median plane of the suitcase. This wing 30 forms a further reinforcing member for the frame 1, as well as a support for receiving, when the case arises, a partition board which may also serve as a support for a flexible pouch which may be placed underneath and attached to the frame.

Referring to FIG. 5, it will be seen that the ends of the recess 10 are preferably slanted. This will facilitate the draining of water which might eventually be infiltrated under the reinforcing plate 11.

I claim:

1. An article of luggage comprising:

a one-piece, generally rigid central frame including a continuous peripheral wall defining an internal opening, the wall transversely extending between opposed peripheral edges and having an externally open recess between the peripheral edges of the wall at a peripherally elongated latch portion thereof;

an elongated, one-piece reinforcing member fixed to the latch portion of the wall to define with the recess an enclosed hollow beam, the reinforcing member including a latch mechanism cavity projecting into the hollow beam proximate each end of the elongated latch portion of the wall and an opening between the latch mechanism cavities for attachment of a top handle;

a first generally rigid shell fixed throughout its periphery to one peripheral edge of the wall; and a second generally rigid shell including hinge means for pivotally connecting a hinge part of the shell periphery to a hinge portion of the wall for selective movement between an open position and a closed position wherein the entire periphery of the second shell engages the other peripheral edge of the wall, the hinge portion being in generally opposed relation to the latch portion of the wall.

2. The article of luggage as in claim 1 wherein the wall includes opposed top and bottom panels and opposed front and rear panels extending between the top and bottom panels and defines a generally rectangular internal opening, the latch portion being in the top panel and the hinge portion being in the bottom panel.

3. The article of luggage as in claim 2 wherein the latch portion is coextensive with the top panel.

4. The article of luggage as in claim 3 wherein the recess extends from each end of the top panel into portions of the opposed front and rear panels.

5. The article of luggage as in claim 4 wherein said reinforcing member includes an extension at each end thereof cooperating with a respective recess extension in the front and rear panels to define the hollow beam in the portions of each of the front and rear panels.

6. The article of luggage as in claim 4 wherein the recess extensions include slanted ends for facilitating drainage of any liquid accumulating in the hollow beam.

7. The article of luggage as in claim 4 also including a side handle and means for connecting it to one end of the reinforcing member for pivotal movement between an extended position and a retracted position wherein the side handle is received in the recess extension in the front panel.

8. The article of luggage as in claim 7 also including a spring biasing the side handle to the retracted position.

9. The article of luggage as in claim 7 also including a retractable castor and means for connecting it to the end of the reinforcing member opposite the side handle for pivotal movement between an extended position and a retracted position wherein the retractable castor is received in the recess extension in the rear panel.

10. The article of luggage as in claim 9 wherein the retractable castor includes a plate and a castor wheel pivotally mounted on one end of the plate for 360° swivel movement, the castor connecting means pivotally attaching the other end of the plate to the end of the reinforcing member.

11. The article of luggage as in claim 7 wherein each of the first and second shells has a wheel recess proximate the intersection of the bottom and rear panels of the central frame and including a support wheel mounted in the wheel recess for rotation about an axis perpendicular to the plane of the periphery of the shell, the support wheels being disposed to rollingly carry the article of luggage when pulled by the side handle.

12. The article of luggage as in claim 11 also including a retractable castor and means for connecting it to the end of the reinforcing member opposite the side handle for pivotal movement between an extended position and a retracted position wherein the retractable castor is received in the recess extension in the rear panel.

13. The article of luggage as in claim 12 wherein the retractable castor includes a plate and a castor wheel pivotally mounted on one end of the plate for 360° swivel movement, the castor connecting means pivotally attaching the other end of the plate to the end of the reinforcing member, the castor wheel in the extended position and the support wheels being disposed to rollingly support the articel of luggage.

14. The article of luggage as in claim 1 wherein the central frame includes a plurality of structural support webs integrally formed in the recess and the reinforcing member includes structural support ribs disposed in engaging relationship with the webs in the recess.

15. The article of luggage as in claim 1 wherein the reinforcing member cooperates with the opposed peripheral edges of the wall at the latch portion thereof to define a generally smooth external surface over the latch portion of the wall.

16. The article of luggage as in claim 15 also including a lock mechanism disposed in each latch mechanism cavity, each lock mechanism cooperating with the reinforcing member to maintain the generally smooth external surface.

17. The article of luggage as in claim 1 wherein the hinge means includes an elongated hinge longitudinally extending along the hinge portion of the wall proximate the other peripheral edge thereof, the hinge pivotally interconnecting the hinge part of the second shell to the hinge portion of the wall.

18. The article of luggage as in claim 17 also including an elongated rib projecting from and longitudinally extending along the hinge portion of the wall proximate the one peripheral edge thereof, the rib and the hinge defining a plane perpendicular to the planes of the peripheral edges.

19. The article of luggage as in claim 1 also including a pair of elongated ribs projecting from and transversely extending along the hinge portion of the wall, one rib being proximate each peripheral edge of the wall, the ribs defining a plane perpendicular to the planes of the peripheral edges.

20. The article of luggage as in claim 1 wherein each peripheral edge of the wall comprises a groove disposed to receive the periphery of a respective one of the first and second shells.

21. The article of luggage as in claim 20 wherein each groove is defined by a pair of opposed, converging walls which frictionally clamp the periphery of a shell disposed therein and wherein the depth of each groove is greater than the space between the converging walls.

22. The article of luggage as in claim 1 wherein the central frame includes an inwardly projecting flange generally parallel and proximate to the other peripheral edge of the wall, the flange being disposed to support a partition board.

23. An article of luggage comprising: a one-piece, generally rigid central frame including a continuous peripheral wall having opposed top and bottom panels and opposed front and rear panels extending between the top and bottom panels, the wall transversely extending between opposed peripheral edges and defining a generally rectangular internal opening;

an externally open recess between the peripheral edges of the wall, the recess being coextensive with the top panel and extending into portions of the front and rear panels;

a plurality of spaced structural support webs integrally formed in the recess; and a substantially continuous, transversely-open groove formed in each opposed peripheral edge of the wall;

an elongated, one-piece reinforcing member fixed to the top panel of the wall enclosing the recess therein to define a hollow beam, the reinforcing member including, a pair of longitudinally spaced latch mechanism cavities, one disposed proximate each opposed end of the reinforcing member and projecting into the hollow beam;

an opening in the reinforcing member between the latch mechanism cavities for receiving a top handle; and integrally-formed structural support ribs configured for interlocking relationship with the structural support webs in the recess;

a first generally rigid shell defining a cavity and having a periphery, the periphery being in fixed mating relationship with the groove formed in one peripheral edge of the wall;

a second generally rigid shell defining a cavity and having a periphery, the periphery being in removable mating relationship with the groove formed in the other peripheral edge of the wall; and a hinge connecting the second shell with the wall at the bottom panel thereof for pivotal movement between an open position and a closed position wherein the periphery of the second shell is in mating relationship with the groove.

24. The article of luggage as in claim 23 also including a side handle and means for connecting it to one end of the reinforcing member for pivotal movement between an extended position and a retracted position wherein the side handle is received in the recess portion in the front panel.

25. The article of luggage as in claim 24 also including a retractable castor and means for connecting it to the other end of the reinforcing member for pivotal movement between an extended position and a retracted position wherein the retractable castor is received in the recess portion in the rear panel.

* * * * *